US009028047B2

(12) United States Patent
Hirai et al.

(10) Patent No.: US 9,028,047 B2
(45) Date of Patent: May 12, 2015

(54) LIQUID EJECTION HEAD AND LIQUID EJECTION RECORDING DEVICE

(71) Applicant: Brother Kogyo Kabushiki Kaisha, Nagoya-shi, Aichi-ken (JP)

(72) Inventors: Keita Hirai, Nagoya (JP); Kazunari Matsuura, Komaki (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 28 days.

(21) Appl. No.: 13/849,398

(22) Filed: Mar. 22, 2013

(65) Prior Publication Data

US 2014/0111579 A1 Apr. 24, 2014

(30) Foreign Application Priority Data

Apr. 2, 2012 (JP) ..... 2012-083679

(51) Int. Cl.
*B41J 2/155* (2006.01)
*B41J 2/14* (2006.01)

(52) U.S. Cl.
CPC ..... *B41J 2/155* (2013.01); *B41J 2/1433* (2013.01); *B41J 2002/14475* (2013.01)

(58) Field of Classification Search
None
See application file for complete search history.

(56) References Cited

U.S. PATENT DOCUMENTS

2003/0103115 A1 6/2003 Watanabe et al.
2007/0126788 A1 6/2007 Takahashi et al.
2007/0236540 A1 10/2007 Hollands
2009/0244240 A1 10/2009 Sugahara
2012/0044302 A1 2/2012 Ito

FOREIGN PATENT DOCUMENTS

| | | | |
|---|---|---|---|
| CN | 101049760 | A | 10/2007 |
| CN | 101549581 | A | 10/2009 |
| EP | 0 985 536 | A1 | 3/2000 |
| JP | 2003-165214 | A | 6/2003 |
| JP | 2004-098579 | A | 4/2004 |
| JP | 2006-159114 | A | 6/2006 |

OTHER PUBLICATIONS

European Patent Office, Extended European Search Report for European Patent Application No. 13160758.2, mailed Jul. 2, 2013.
Office Action issued in related Chinese Patent Application No. 201310087524.4, mailed Sep. 3, 2014.

*Primary Examiner* — Justin Seo
(74) *Attorney, Agent, or Firm* — Merchant & Gould PC

(57) ABSTRACT

A liquid ejection head includes an ejection surface having a plurality of ejection opening sets each of which consists of at least two ejection openings adjacent to each other in a given direction. A straight line defined to connect between centers of the respective at least two ejection openings is parallel with the ejection surface and is inclined with respect to the given direction and a perpendicular direction that is perpendicular to the given direction. The straight line defined in one of each adjacent two of the ejection opening sets, which are adjacent to each other in the given direction, and the straight line defined in another of the each adjacent two of the ejection opening sets, are inclined with respect to the perpendicular direction, in respective directions opposite to each other. Also disclosed is a liquid ejection recording device including the liquid ejection head.

8 Claims, 8 Drawing Sheets

| | | | | | | | | | | | | | | | | | | | |
|---|---|---|---|---|---|---|---|---|---|---|---|---|---|---|---|---|---|---|---|
| A ① | B ② | A ③ | B ④ | A ⑤ | B ⑥ | A ⑦ | B ⑧ | A ⑨ | B ⑩ | A ⑪ | B ⑫ | A ⑬ | B ⑭ | A ⑮ | B ⑯ | A ⑰ | B ⑱ | A ⑲ | B ⑳ |

FIG. 8A

| | | | | | | | | | | | | | | | | | | | |
|---|---|---|---|---|---|---|---|---|---|---|---|---|---|---|---|---|---|---|---|
| A ① | | | | | | A ⑦ | | | | | | A ⑬ | | | | | | A ⑲ | |
| | B ② | | | | | | B ⑧ | | | | | | B ⑭ | | | | | | B ⑳ |
| | | A ③ | | | | | | A ⑨ | | | | | | A ⑮ | | | | | |
| | | | B ④ | | | | | | B ⑩ | | | | | | B ⑯ | | | | |
| | | | | A ⑤ | | | | | | A ⑪ | | | | | | A ⑰ | | | |
| | | | | | B ⑥ | | | | | | B ⑫ | | | | | | B ⑱ | | |

FIG. 8B

| | | | | | | | | | | | | | | | | | | | |
|---|---|---|---|---|---|---|---|---|---|---|---|---|---|---|---|---|---|---|---|
| A ① | | | | | B ⑥ | | | | | A ⑪ | | | | | B ⑯ | | | | |
| | B ② | | | | | A ⑦ | | | | | B ⑫ | | | | | A ⑰ | | | |
| | | A ③ | | | | | B ⑧ | | | | | A ⑬ | | | | | B ⑱ | | |
| | | | B ④ | | | | | A ⑨ | | | | | B ⑭ | | | | | A ⑲ | |
| | | | | A ⑤ | | | | | B ⑩ | | | | | A ⑮ | | | | | B ⑳ |

FIG. 8C

| | | | | | | | | | | | | | | | | | | | |
|---|---|---|---|---|---|---|---|---|---|---|---|---|---|---|---|---|---|---|---|
| A ① | B ② | | | | | | | A ⑨ | B ⑩ | | | | | | | A ⑰ | B ⑱ | | |
| | | A ③ | B ④ | | | | | | | A ⑪ | B ⑫ | | | | | | | A ⑲ | B ⑳ |
| | | | | A ⑤ | B ⑥ | | | | | | | A ⑬ | B ⑭ | | | | | | |
| | | | | | | A ⑦ | B ⑧ | | | | | | | A ⑮ | B ⑯ | | | | |

FIG. 8D

LIQUID EJECTION HEAD AND LIQUID EJECTION RECORDING DEVICE

CROSS REFERENCE TO RELATED APPLICATION

This application claims priority from Japanese Patent Application No. 2012-083679 filed on Apr. 2, 2012, the disclosure of which is herein incorporated by reference in its entirety.

BACKGROUND OF THE INVENTION

1. Field of the Invention

The present invention relates to a liquid ejection head configured to eject a liquid, and also to a liquid ejection recording device including the liquid ejection head.

2. Discussion of Related Art

There is known a recording head that is provided with a plurality of ink channels each having two nozzle holes. The two nozzle holes of each ink channel are positioned relative to each other such that a straight line that is defined to connect between centers of the respective two nozzle holes intersects with a main scanning direction and a sub-scanning direction of the recording head. Further, the plurality of channels are arranged in the sub-scanning direction such that the straight lines defined in the respective channels are parallel with each other.

SUMMARY OF THE INVENTION

However, a single dot (pixel) is formed by using the recording head described above, is elongated in a direction in which the two nozzle holes are arranged. Therefore, when two straight lines orthogonal to each other are recorded by this recording head, there is a difference between the two straight lines with respect to a thickness or width of the line. For example, a straight line extending in the direction of arrangement of the two nozzle holes is constituted by a succession of long axes of the respective pixels, so that the width of the line is substantially equal to a short axis or width of the pixel and is accordingly small. Meanwhile, a straight line, which is orthogonal to the above-described straight line, is constituted by a succession of short axes of the respective pixels, so that the width of the line is substantially equal to a long axis or length of the pixel and is accordingly large. Such a difference in width between the lines leads to a reduction in image quality.

It is therefore a first object of the invention to provide a liquid ejection head that is capable of restraining a reduction in image quality.

A liquid ejection head according to the invention includes: (a) an ejection surface having a plurality of ejection opening sets that are equally spaced apart from each other in a given direction, each of the ejection opening sets consisting of at least two ejection openings that are adjacent to each other in the given direction; (b) a plurality of pressure chambers; (c) a plurality of individual liquid channels connecting each of the pressure chambers to a corresponding one of the ejection opening sets; and (d) an ejection energy applier configured to apply an ejection energy to a liquid stored in selected at least one of the pressure chambers so as to cause liquid droplets to be ejected through at least one of the ejection opening sets that are connected to the selected at least one of the pressure chambers, such that the liquid droplets ejected through the at least two ejection openings constituting each of the at least one of the ejection opening sets cooperate with each other to form a single pixel, wherein the at least two ejection openings of each of the ejection opening sets are positioned relative to each other, such that a straight line that is defined to connect between centers of the respective at least two ejection openings is parallel with the ejection surface and is inclined with respect to the given direction and a perpendicular direction that is perpendicular to the given direction, and such that the straight line defined in one of each adjacent two of the ejection opening sets, which are adjacent to each other in the given direction, and the straight line defined in another of the each adjacent two of the ejection opening sets are inclined with respect to the perpendicular direction, in respective directions opposite to each other. It is noted that the straight line defined in one of each adjacent two of the ejection opening sets may be parallel with a first intersecting direction that intersects with the given direction and the perpendicular direction, and the straight line defined in another of each adjacent two of the ejection opening sets may be parallel with a second intersecting direction that intersects with the given direction and the perpendicular direction, wherein the first intersecting direction and the second intersecting direction are inclined with respect to the perpendicular direction, in respective directions opposite to each other.

A second object of the invention is to provide a liquid ejection recording device that is capable of restraining a reduction in image quality. A liquid ejection recording device according to the invention includes: the above-described liquid ejection head; and a sheet conveyor configured to convey a recording medium that is to be subjected to an image recording performed by the liquid ejection recording device, wherein the image recording is performed by ejection of the liquid droplets from the liquid ejection head, during conveyance of the recording medium relative to the liquid ejection head in the perpendicular direction, without movement of the recording medium relative to the liquid ejection head in the given direction.

BRIEF DESCRIPTION OF THE DRAWINGS

FIGS. 8A-8D is a set of views for describing modifications of the embodiment of the invention.

DETAILED DESCRIPTION OF THE PREFERRED EMBODIMENT

There will be described preferred embodiment of the present invention, with reference to the drawings.

Figure 1:
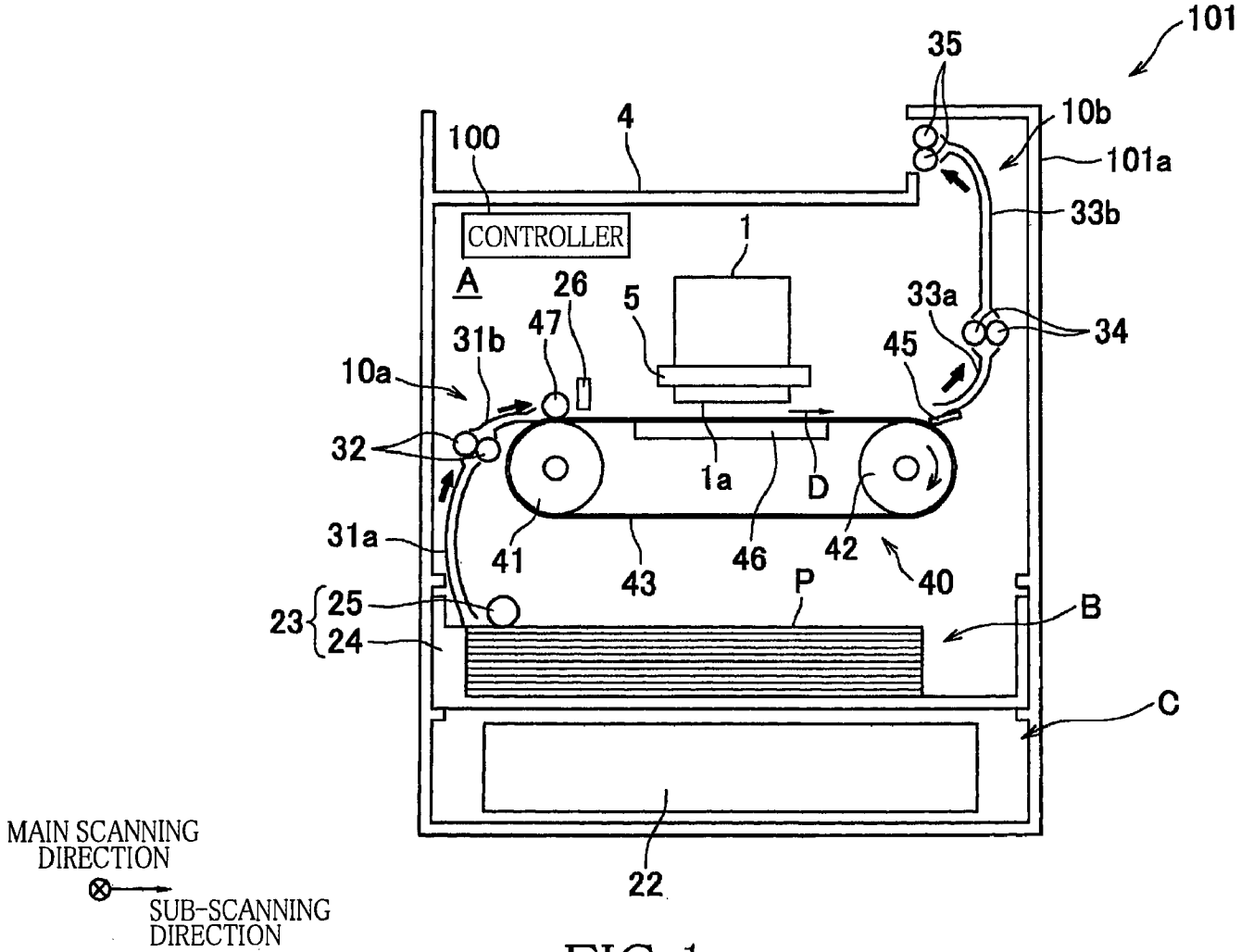
FIG. 1 is a side view schematically showing an internal construction of an inkjet printer including a liquid ejection head that is constructed according to an embodiment of the invention.

Referring first to FIG. 1, there will be described an inkjet printer 101 as an example of a liquid ejection device or a liquid ejection recording device employing a liquid ejection head that is constructed according to the invention.

The printer 101 has a generally rectangular parallelepiped-shaped housing body 101*a*. A sheet exit portion 4 is provided on a top plate of the housing body 101*a*. An inner space within the housing body 1*a* is sectioned into three space sections A, B, C that are arranged in this order of description as seen from top to bottom. In the space sections A, B, there is defined a sheet conveyance path, along which a sheet P as an example of a recording medium is to be conveyed in a conveyance direction indicated by thick arrows (black arrows) in FIG. 1, from a sheet supply unit 23 to the sheet exit portion 4. In the space section A, an image recording is performed on the sheet P and the sheet P is conveyed to the sheet exit portion 4. In the space section B, the sheet P is supplied to the sheet conveyance path. A head 1 is disposed in the space section A, and is configured to eject a black ink. The head 1 receives the ink supplied from a cartridge 22 as an ink reservoir that is disposed in the space section C.

In the space section A, there are disposed a conveying unit 40 as an example of a sheet conveyor, two guide portions 10*a*, 10*b*, a sheet detection sensor 26 and a controller 100, for example, in addition to the head 1. The two guide portions 10*a*, 10*b* are provided for guiding the conveyed sheet P.

Figure 4A:
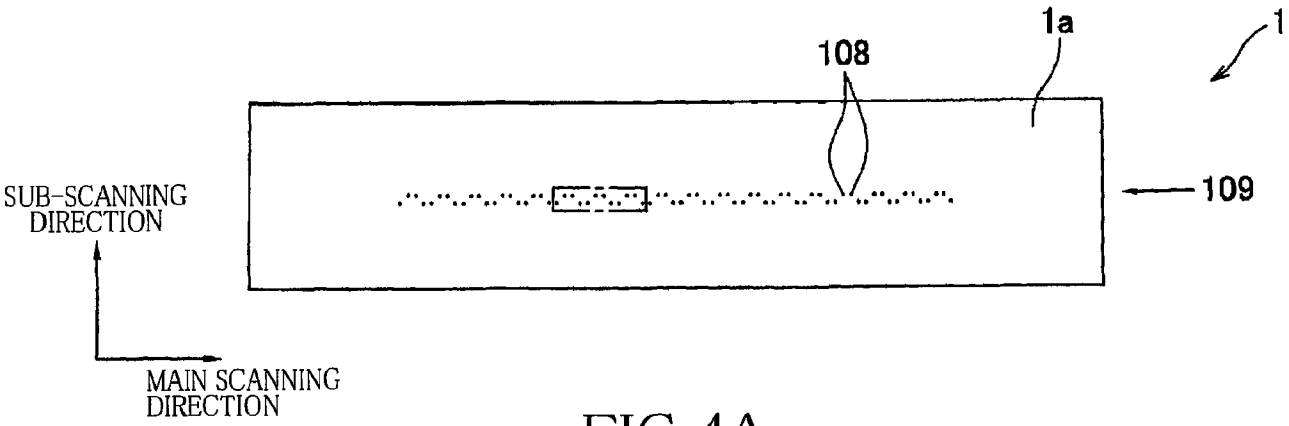
FIG. 4A is a plan view of an ejection surface of the liquid ejection head that is shown in FIG. 1.
Figure 4B:
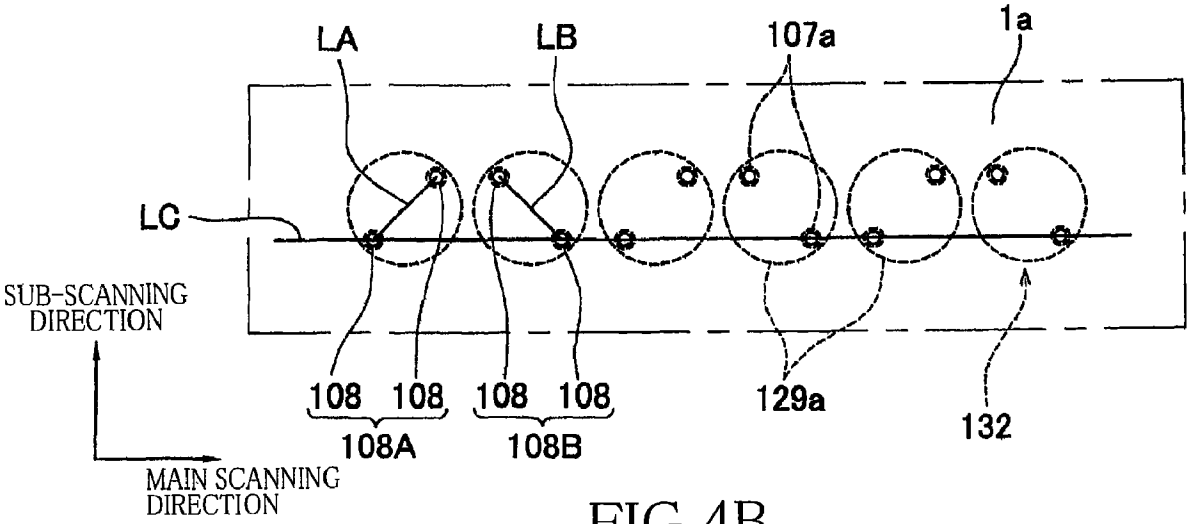
FIG. 4B is a view showing, in enlargement, a region surrounded by one-dot chain line shown in FIG. 4A.

The head 1 as an example of the liquid ejection head is held by the housing body 101*a* through a head holder 5. The head 1 has a lower surface (i.e., an outside surface) that serves as an ejection surface 1*a* in which a plurality of ejection openings 108 are arranged as shown in FIGS. 4A and 4B. The head 1 is held, by the head holder 5, in a position relative to a conveyor belt 43 such that the head 1 and the conveyor belt 43 cooperate with each other to define therebetween a clearance that is suitable the image recording. Further, the head 1 held by the head holder 5 such that the ejection surface 1*a* of the head 1 is held level.

The head 1 is a laminated body mainly constituted by a main body 3 (see FIG. 2), a reservoir unit, a flexible printed circuit board (FPC) and a control board that are superposed on one another. The control circuit is configured to condition signals, and the conditioned signals are converted into drive signals by a driver IC that is disposed on the FPC. The drive signals are supplied to an actuator unit 21 that cooperates with a flow channel unit 9 to constitute the above-described main body 3. When the actuator unit 21 is activated, the ink supplied from the reservoir unit is ejected through the ejection openings 108.

The conveying unit 40 has two belt pulleys 41, 42, a conveyor belt 43, a platen 46, a nip roller 47 and a separator plate 45. The conveyor belt 43 is constituted by an endless belt that is looped around the two belt pulleys 41, 42. The platen 46 is disposed to be opposed to the head 1, and supports an upper portion of the conveyor belt 43 from inside of the belt 43. The conveyor belt 43 is caused to run, by rotation of the belt pulley 42 as a drive pulley. The belt pulley 42 is rotated in a clockwise direction as seen in FIG. 1, by a motor (not shown). The belt pulley 41 is a driven pulley, and is rotated by running of the conveyor belt 43. The nip roller 47 is disposed to be opposed to the belt pulley 41, and presses the sheet P supplied from a sheet supply unit 23, against an outer circumferential surface of the conveyor belt 43. The conveyor belt 43 is coated at its outer circumferential surface with a silicon layer having a low degree of adhesiveness, so that the sheet P can be held on the conveyer belt 43, so as to be conveyed toward the head 1. The separator plate 45 is provided to separate the conveyed sheet P from the conveyor belt 43, so as to guide toward the sheet exit portion 4 that is located on a downstream side of the separator plate 45.

The two guide portions 10*a*, 10*b* are located on respective upstream and downstream sides of the conveying unit 40 in the conveyance direction. The upstream-side guide portion 10*a* includes two guides 31*a*, 31*b* and a pair of feeding rollers 32, and bridges between the sheet supply unit 23 and the conveying unit 40, so that the sheet P (that is to be subjected to an image recording) is guided by the upstream-side guide portion 10*a* and is fed to the conveying unit 40. The downstream-side guide portion 10*b* includes two guides 33*a*, 33*b* and two pairs of discharging rollers 34, 35, and bridges between the conveying unit 40 and the sheet exit portion 4, so that the sheet P (that has been subjected to the image recording) is guided by the downstream-side guide portion 10*b* and is discharged to the sheet exit portion 4.

The sheet detection sensor 26 is disposed on an upstream side of the head 1, and is configured to detect a leading end of the conveyed sheet P. Upon detection of the leading end of the sheet P, the sensor 26 outputs a signal that is to be used for a synchronization between activations of the respective head 1 and conveying unit 40, so that the image recording is performed at a desired degree of image resolution and a desired image recording speed.

The sheet supply unit 23 is disposed in the space section B, and includes a sheet supply tray 24 and a sheet supplying roller 25. The sheet supply tray 24 is constituted by a box having an upper opening, and is removably received in the housing body 101*a*, so as to store therein a plurality of sheets P. The sheet supplying roller 25 is controlled by the controller 100, so as to pick up an uppermost one of the sheets P stacked in the sheet supply tray 24 and supply the uppermost sheet P to the upstream-side guide portion 10*a*

In the following description, a sub-scanning direction refers to a direction parallel with a sheet conveyance direction D in which the sheet P is to be conveyed by the conveying unit 40, while a main scanning direction refers to a direction which is parallel with a horizontal surface (such as the ejection surface 1*a*) and which is perpendicular to the sub-scanning direction.

The cartridge 22 storing therein the black ink is removably received in the housing body 101*a*, and is located in the space section C. The cartridge 22 is connected to the head 1 via a tube (not shown) and a pump (not shown). It is noted that the pump is not activated and is placed in its stop state, except when the ink is to be forcedly supplied to the head 1 (for example, in case of initial introduction of the ink into the head 1), so that supply of the ink from the cartridge 22 to the head 1 is not impeded by the pump.

Next, the controller 100 will be described. The controller 100 is configured to control operations performed in an entirety of the printer 101, by controlling activations of various components of the printer 101. The controller 100 is configured to control an image recording operation performed in the printer 101, based on printing signals supplied from an external device (such as a personal computer connected to the printer 101). Specifically, the controller 100 controls conveyance motion of the sheet P and ink ejection that is executed in synchronization with the conveyance motion of the sheet P.

The controller 100 causes the sheet supply unit 23, conveying unit 40 and pairs of rollers 32, 34, 35 to be activated based on the printing signals supplied from the external device. The sheet P supplied from the sheet supply tray 24 is guided by the upstream-side guide portion 10*a* so as to be fed to the conveying unit 40. When the sheet P conveyed by the conveying unit 40 passes right below the head 1, the ink is ejected toward the sheet P whereby a desired image is formed on the sheet P. The sheet P having the image formed thereon is separated from the conveyor belt 43 by the separator plate 45, and is then guided by the downstream-side guide portion 10*b* so as to be discharged from an upper portion of the housing body 101*a* to the sheet exit portion 4. In the present embodiment, the inkjet printer 101 is a line-type inkjet printer, so that the image recording is performed by ejection of ink droplets from the head 1, during conveyance of the sheet P relative to the head 1 in the sub-scanning direction, without movement of the sheet P relative to the head 1 in the main scanning direction.

Figure 2:
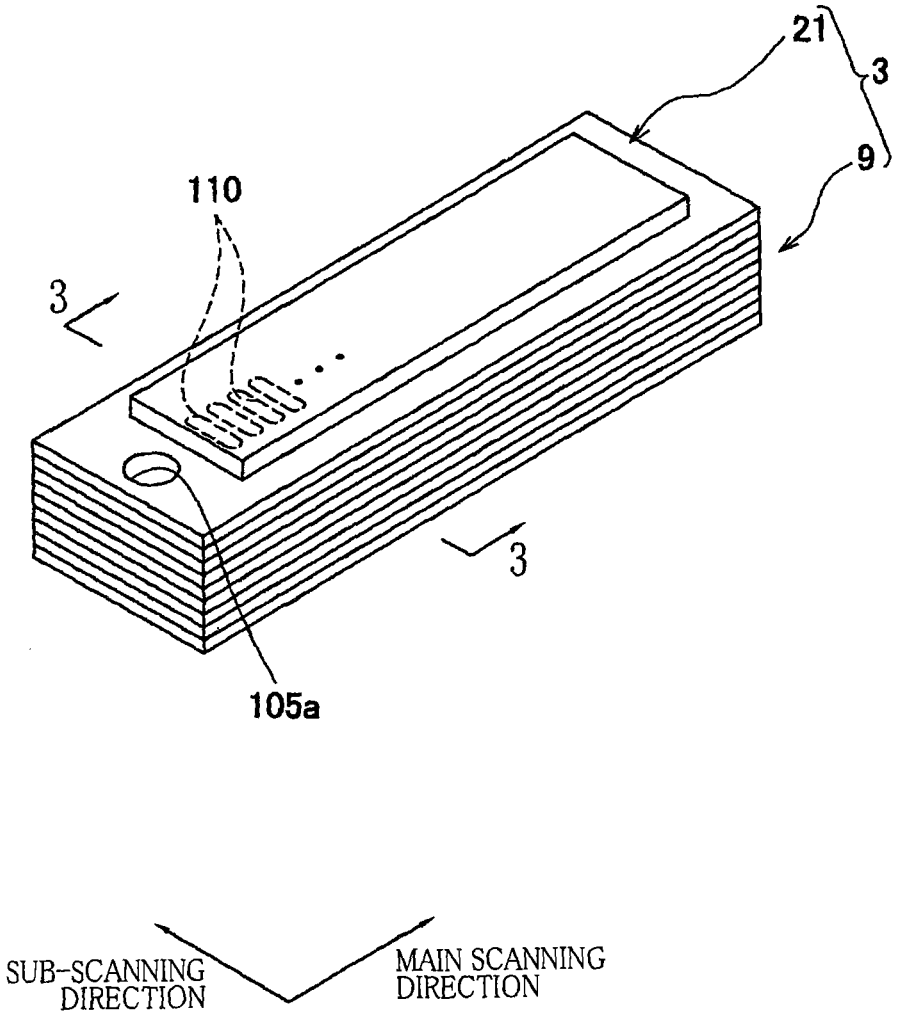
FIG. 2 is a perspective view schematically showing a main body of the liquid ejection head that is shown in FIG. 1.

Referring next to FIGS. 2-5, the head 1 will be described in detail. The main body 3 of the head 1 is a laminated body mainly constituted by the flow channel unit 9 and the actuator unit 21 that is fixed onto an upper surface of the flow channel unit 9, as shown in FIG. 2. The main body 3 is a generally rectangular parallelepiped-shaped body that is elongated in the main scanning direction. A plurality of pressure chambers 110 open in an upper surface of the flow channel unit 9, and openings of the respective pressure chambers 110 are arranged in the main scanning direction. The openings of the respective pressure chambers 110 are closed by the actuator unit 21 that constitutes upper walls of the respective pressure chambers 110.

Figure 3:
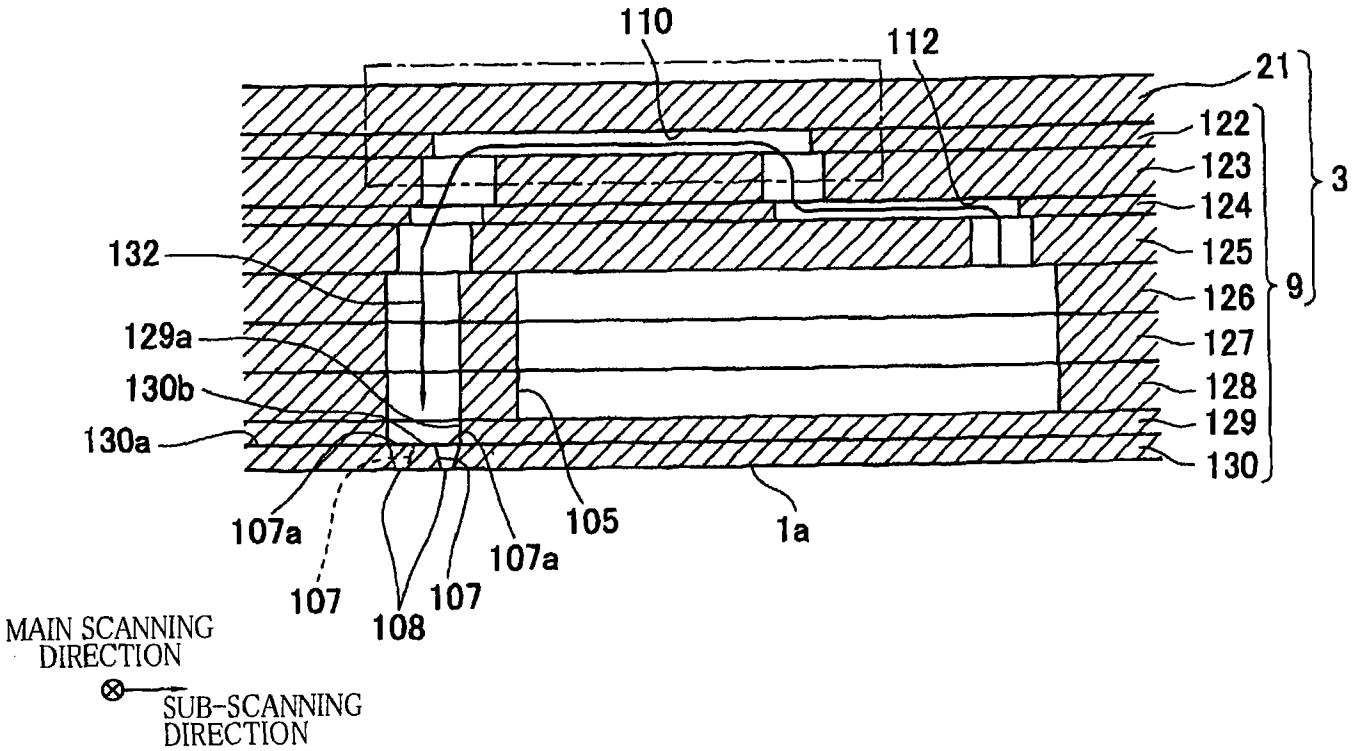
FIG. 3 is a cross sectional view taken along ling 3-3 shown in FIG. 2.

As shown in FIG. 3, the flow channel unit 9 is a laminated body constituted by a total of nine metal plates 122-130 which are made of stainless steel and are superposed on each other. As shown in FIG. 2, an ink inlet 105*a* is provided to open in an upper surface of the flow channel unit 9. As shown in FIG. 3, a manifold chamber 105 is defined in the flow channel unit 9 and is held in communication with the ink inlet 105*a*. The manifold chamber 105 extends in the main scanning direction. Further, a plurality of individual ink channels (as an example of a plurality of individual liquid channels) are defined in the flow channel unit 9. Each of the individual ink channels 132 is constituted by a plurality of through-holes which are provided in the respective metal plates 122-130 and which are held in communication with one another. Each of the individual ink channels 132 extends from an exit of the manifold chamber 105 to the two ejection openings 108 of a corresponding one of the ejection opening sets via an aperture 112 and a corresponding one of the pressure chambers 110. As shown in FIG. 4B, some of the individual ink channels 132 are held in communication with the ejection opening sets 108A, while the other of the individual ink channels 132 are held in communication with the ejection opening sets 108B.

The flow channel unit 9 has a lower surface that serves the ejection surface 1*a* in which the multiplicity of ejection openings 108 open. As shown in FIG. 4A, the ejection openings 108 are arranged in the main scanning direction. Each of the ejection opening sets 108A, 108B is constituted by a corresponding adjacent pair of the ejection openings 108, which are adjacent to each other in the main scanning direction. The ejection opening sets 108A, 108B are alternately arranged in the main scanning direction, and forms an ejection-opening set row 109. Further, the ejection opening sets 108A, 108B are arranged and equally spaced apart from each other in the main scanning direction. That is, a spacing distance between each adjacent two of the ejection opening sets 108A, 108B is constant in the main scanning direction.

In each ejection opening set, a straight line L can be defined to connect between centers of the respective two ejection openings 108 that cooperate with each other to constitute each ejection opening set, a shown in FIG. 4B. The straight line is inclined with respect to the main scanning direction and the sub-scanning direction. Each ejection opening set is categorized into the ejection opening sets 108A or the ejection opening sets 108B, depending on a direction of the inclination of the straight line or a degree of the inclination of the straight line with respect to the main scanning direction. The imaginary straight line LA defined in each ejection opening set 108A extends in a right upward direction as seen in FIG. 4B, so as to be inclined by 45° with respect to the main scanning direction. Meanwhile, the imaginary straight line LB defined in each ejection opening set 108B extends in a left upward direction as seen in FIG. 4B, so as to be inclined by 135° with respect to the main scanning direction. That is, the two straight lines LA, LB defined in each adjacent two of the ejection opening sets 108A, 108B are inclined with respect to the sub-scanning direction, in respective directions opposite to each other. Two ink droplets are concurrently ejected through each ejection opening set 108A, and the two concurrently ejected ink droplets cooperate with each other to form one dot (i.e., pixel) DA. Similarly, two ink droplets are concurrently ejected through each ejection opening set 108B, and the two concurrently ejected ink droplets cooperate with each other to form one dot (i.e., pixel) DB.

As shown in FIG. 3, the nozzle plate 130, which is the lowermost one of the nine metal plates 122-130, has through-holes 107. Each of the through-holes 107 has an ejection opening 108 that opens in the ejection surface 1*a* that is constituted by one of opposite side surfaces of the nozzle plate 130, and also another opening 107*a* that opens in an opposite surface 130*a* that is constituted by the other of the opposite side surfaces of the nozzle plate 130. Each through-hole 107 is a tapered hole having a diameter that is increased as viewed in a direction away from the opening 107*a* toward the ejection opening 108. In the present embodiment, axes of each pair of the through-holes 107 are parallel with each other, and a distance between the axes is 60 μm. Each through-hole 107 has a frustoconical shape, and has a height or axial length of 30 μm. The opening 107*a* has a diameter of 40 μm, while the ejection opening 108 has a diameter of 15 μm. The openings 107*a* of each pair of the through-holes 107 are spaced apart from each other by 20 μm. That is, between the openings 107*a* which correspond to a corresponding one of the ejection opening sets 108A, 108B, there is a flat surface area 130*b*, as shown in FIG. 3, which has a smallest width of 20 μm. The presence of the flat surface area 130*b* leads to an improvement in telecentricity of the nozzles that relates to flight behavior of the ejected ink droplets, thereby making is possible to cause the two ink droplets concurrently ejected through each pair of ejection openings 108 (i.e., ejection opening set) to fly substantially in parallel with each other, so as to obtain a high image quality. The metal plate 129 which is adjacent to the nozzle plate 130 has through-holes 129*a* each of which is connected to a corresponding pair of the through-holes 107. As seen in a plan view, the two openings 107*a* of each pair of the through-holes 107 are located inside a corresponding one of the through-holes 129*a*.

Like the flow channel unit 9, the reservoir unit is a flow channel member that defines an ink channel therein. The ink is stored in the ink channel defined in the reservoir unit, and is supplied through the ink inlet 105*a* into the flow channel unit 9.

There will be next described the actuator unit 21. The actuator unit 21 is fixed onto an upper surface of the flow channel unit 9, so as to cooperate with the flow channel unit 9 to constitute the main body 3 of the head 1. As shown in FIG. 2, the actuator unit 21 is constituted by a generally rectangular parallelepiped-shaped body that is elongated in the main scanning direction, and covers all of the pressure chambers 110.

Figure 5:
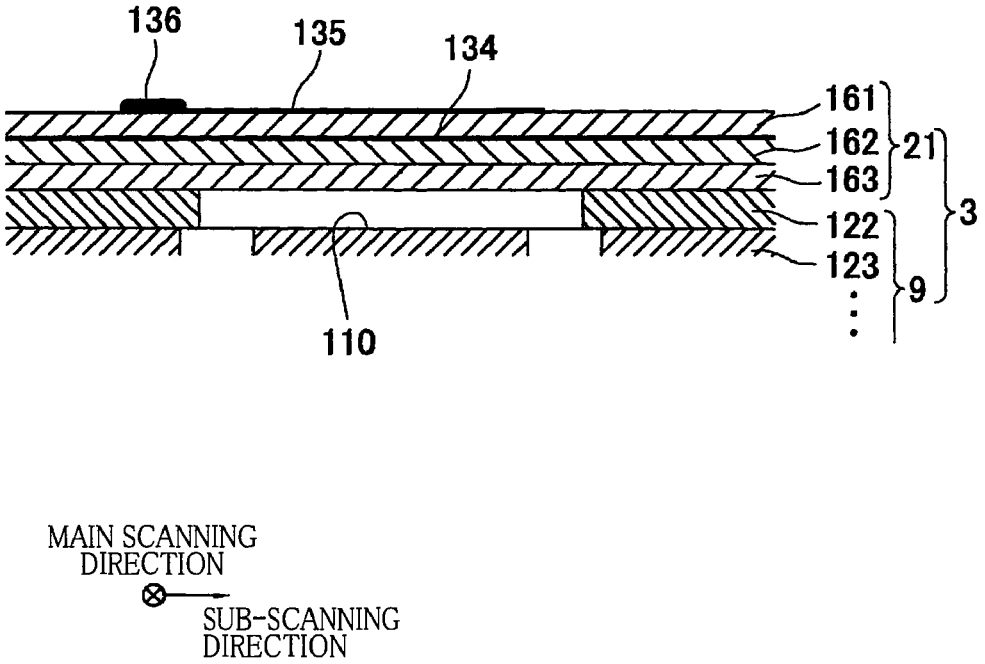
FIG. 5 is a view showing, in enlargement, a region surrounded by one-dot chain line shown in FIG. 3.

The actuator unit 21 as an example of an ejection energy applier is a piezo-type actuator that is constituted by three piezoelectric layers 161-163 each made of PZT (lead zirconate titanate) ceramic material and having ferroelectricity, as shown in FIG. 5. The piezoelectric layer 161, which is an uppermost one of the three piezoelectric layers 161-163, is polarized in its thickness direction and is interposed between a plurality of individual electrodes 135 and a common electrode 134 that is disposed on an entirety of a lower surface of the piezoelectric layer 161. Each of the individual electrodes 135, which are disposed on an upper surface of the piezoelectric layer 161, includes a major portion that is opposed to a corresponding one of the pressure chambers 110. Each individual electrode 135 includes a portion which is outside the corresponding pressure chamber 110 as seen in a plan view and which is connected to a corresponding one of individual lands 136. Thus, a plurality of actuators are provided for the respective pressure chambers 110, and are activatable independently of each other. That is, the actuator unit 21 includes the same number of actuators as the pressure chambers 110, so that the actuator unit 21 is configured to apply an ejection energy to the ink stored in each of a selected one or ones of the pressure chambers 110 by causing a corresponding one or ones of the actuators to be activated.

There will be described a manner in which the actuator unit 21 is to be activated. Each of the actuators of the actuator unit 21 is of a so-called unimorph type. Each portion, which is interposed between the corresponding individual electrode 135 and the common electrode 134, is caused to contract in a surface direction (i.e., a direction perpendicular to a direction of polarization) when an electric field is applied thereto in the direction of polarization. In this instance, there is caused a difference between the each portion of the piezoelectric layer 161 and the corresponding portions of the piezoelectric layers 162, 163, with respect to an amount of distortion or deformation in the surface direction, thereby causing these portions interposed between the corresponding individual electrode 135 and the corresponding pressure chamber 110 to be convexed downwardly toward the corresponding pressure chamber 110. Consequently, a pressure (i.e., ejection energy) is applied to the ink stored in the corresponding pressure chamber 110 whereby the ink is ejected as an ink droplet.

In the present embodiment, each individual electrode 135 is given an electric potential of a predetermine level. Upon supply of a driving signal, the electric potential of each individual electrode 135 is once placed into a ground level, and is then returned to the predetermined level at a given point of time. That is, the ink ejection is performed by a so-called pull striking. At a point of time at which the electric potential of each individual electrode 135 is placed into the ground level, a volume of the corresponding pressure chamber 110 is increased whereby the ink is sucked into the pressure chamber 110. Then, when the electric potential is returned to the predetermined level, the volume of the pressure chamber 110 is reduced whereby the ink pressure is increased, so that the ink droplets are concurrently ejected through the two ejection openings 108 that are held in communication with the same pressure chamber 110.

Figure 6:
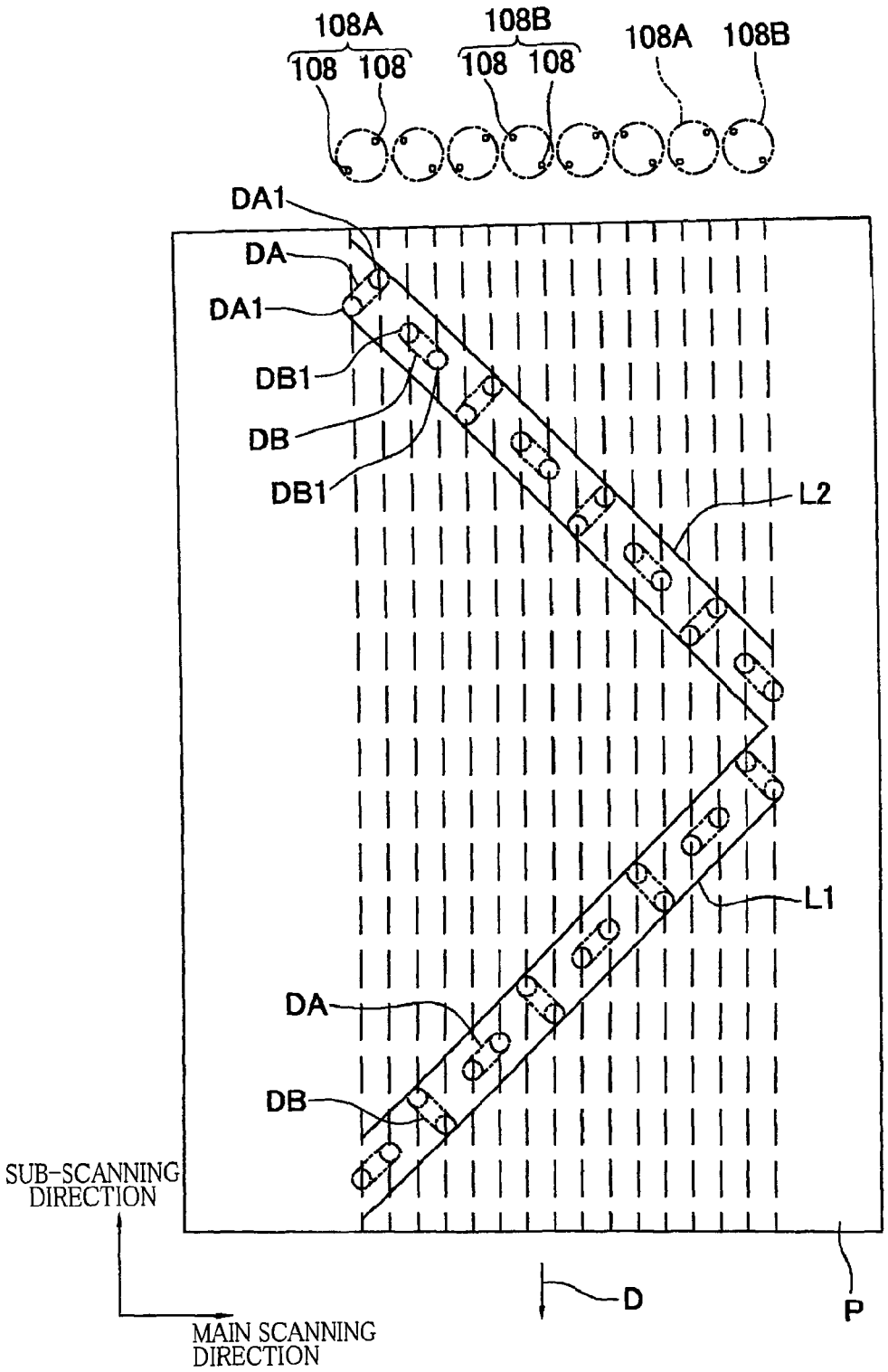
FIG. 6 is a view showing a case where two straight lines orthogonal to each other are recorded on a sheet by using the liquid ejection head of the embodiment of the invention.

Referring next to FIG. 6, there will be described a case when straight lines L1, L2 intersecting with the main scanning direction and sub-scanning direction are printed on the sheet P. The straight line L1 is inclined by 45° with respect to the main scanning direction and is parallel with the imaginary straight line LA. The straight line L2 is inclined by 135° with respect to the main scanning direction and is parallel with the imaginary straight line LB.

When the straight line L1 is to be printed on the sheet P, the sheet P is conveyed, by the conveying unit 40, for example, in a sheet conveyance direction D. Then, in a stage in which the sheet P is opposed with the ejection surface 1*a*, two ink droplets are concurrently ejected through each of the ejection opening sets 108A,108B at a given point of time. In this stage, firstly, two ink droplets are ejected through the ejection opening set 108A that is located in a left end as seen in FIG. 6, whereby a dot DA is formed on the sheet P. Next, in synchronization with the conveyance of the sheet P, two ink droplets are ejected through the ejection opening set 108B that is located on an immediately right side of the ejection opening set 108A, whereby a dot DB is formed on the sheet P. Thus, the dots DA, DB are alternately formed, and the alternately formed dots DA, DB are connected to one another, whereby the straight line L1 is drawn on the sheet P.

The straight line L2 is printed in the same manner as the straight line L1. That is, firstly, two ink droplets are ejected through the ejection opening set 108B that is located in a right end as seen in FIG. 6, whereby a dot DB is formed on the sheet P. Next, in synchronization with the conveyance of the sheet P, two ink droplets are ejected through the ejection opening set 108A that is located on an immediately left side of the ejection opening set 108B, whereby a dot DA is formed on the sheet P. Thus, the dots DB, DA are alternately formed, and the alternately formed dots DB, DA are connected to one another, whereby the straight line L2 is drawn on the sheet P.

As shown in FIG. 6, each dot DA is constituted by the two ink droplets DA1 and is elongated in a direction parallel with the imaginary straight line LA. Each dot DB is constituted by the two ink droplets DB 1 and is elongated in a direction parallel with the imaginary straight line LB. Since the ejection opening sets 108A, 108B are alternately arranged in the main scanning direction, the dots DA, DB are also alternately arranged in the main scanning direction, and the straight lines L1, L2 are formed by the alternately arranged dots DA, DB.

The straight line L1 has a width whose maximum value is equal to a length of the dot DB and whose minimum value is equal to a width of the dot DA. Meanwhile, the straight line L2 has a width whose maximum value is equal to a length of the dot DA and whose minimum value is equal to a width of the dot DB. Thus, the length and width of the dot DA constitute the maximum value of the width of the straight line L2 and the minimum value of the width of the straight line L1, respectively. On the other hand, the length and width of the dot DB constitute the maximum value of the width of the straight line L1 and the minimum value of the width of the straight line L2, respectively. Thus, the dots DA, DB contribute in formations of the straight lines L1, L2 in respective manners different from each other. However, since the dots DA, DB are the same as each other in length and width, the straight lines L1, L2 are the same as each other in average width. In an arrangement where the head has only the ejection opening sets 108A, the straight line L1 would be constituted by a succession of the lengths of the respective dots DA while the straight line L2 would be constituted by a succession of the widths of the respective dots DA, so that the width of the straight line L1 would be smaller than the width of the straight line L2, thereby causing a reduction in the image quality. The same thing could be said in an arrangement where the head has only the ejection opening sets 108B. However, in the present invention, when two lines are drawn, the drawn lines are the same as each other in average width even if the two lines are orthogonal to each other, thereby making it possible to restrain a reduction in the image quality.

As described above, according to the head 1 of the present embodiment, when two lines are drawn, the drawn lines are the same as each other in width even if the two lines are orthogonal to each other, thereby making it possible to restrain a reduction in the image quality. Further, since the head 1 includes the nozzle plate 130, the plurality of through-holes 107 for constituting the ejection openings 108 can be formed in the plate 130 as a portion that is formed independently of the other portions of the head 1, thereby facilitating manufacture of the head 1.

Further, on the ejection surface 1*a*, the ejection opening sets 108A, 108B are arranged to form the single ejection-opening set row 109. Therefore, the width of the nozzle plate 130 (as measured in the sub-scanning direction or perpendicular direction) can be made small, and accordingly, width of the head 1 can be made small.

Further, the imaginary straight line LA is inclined by 45° with respect to an imaginary straight line LC that is parallel with the main scanning direction, while the imaginary straight line LB is inclined by 135° with respect to the imaginary straight line LC. Therefore, when two straight lines extending in the main scanning direction and the sub-scanning direction, respectively, are drawn, the two straight lines have respective average width values that are equal to each other. Such a feature regarding the line width is advantageous in a print quality, in view of a fact that straight lines (e.g., vertical line, horizontal line and diagonal line) are frequently drawn in a printing operation. Thus, the arrangement of the ejection openings 108 according to the present invention, which realizes this technical feature, provides a high degree of practicability.

Figure 7:
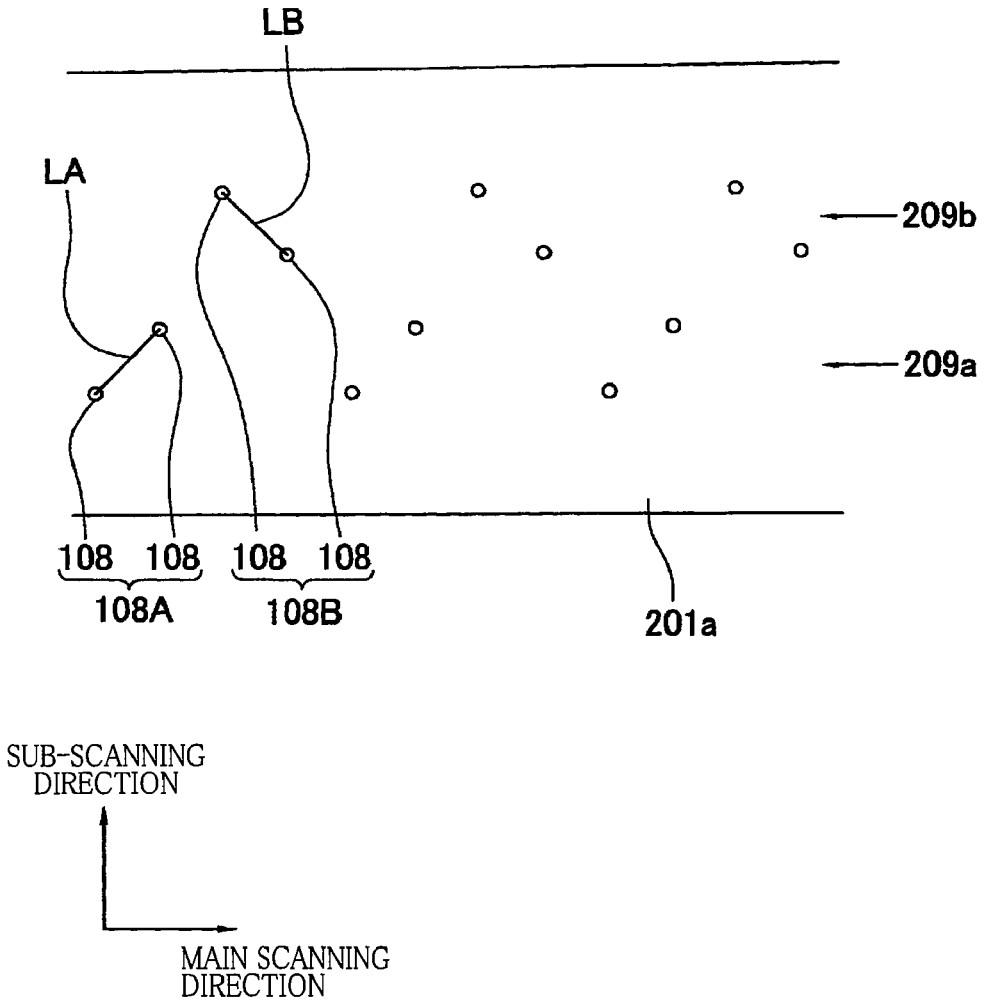
FIG. 7 is a view showing, in enlargement, an ejection surface of a liquid ejection head constructed according to a modification of the embodiment of the invention.

In the above-described embodiment, the head 1 has the ejection surface 1*a* in which only the single ejection-opening set row 109 is formed. However, as shown in FIG. 7, the head 1 may have an ejection surface 201*a* in which a plurality of ejection-opening set rows 209 are formed. In this modified arrangement, two ejection-opening set rows 209*a*, 209*b* are formed. The ejection-opening set row 209*a* is formed by the above-described plurality of ejection opening sets 108A that are arranged and equally spaced apart from each other in the main scanning direction. The ejection-opening set row 209*b* is formed by the above-described plurality of ejection opening sets 108B that are arranged and equally spaced apart from each other in the main scanning direction. Each of the ejection opening sets 108B is located at a center between corresponding adjacent two of the ejection opening sets 108A, which are adjacent to each other in the main scanning direction, in the main scanning direction. The ejection opening sets 108A and the ejection opening sets 108B are alternately arranged in the main scanning direction. In this modified arrangement, one and another of each adjacent two of the ejection opening sets 108A, 108B, which are adjacent to each other in the given direction, belong to respective ejection-opening set rows 209*a*, 209*b* that are other than each other, so that the one and another of each adjacent two of the ejection opening set rows 209*a*, 209 may be distant from each other in the perpendicular direction. Therefore, it is possible to reduce a number of the ejection openings 108 per an unit area of the nozzle plate 130, and accordingly to restrain a reduction in a strength of local portions of the nozzle plate 130.

It is noted that the number of the ejection-opening set rows may be three or more so that the reduction in the strength of the nozzle plate 130 can be further restrained. Referring to FIGS. 8A-8D, there will be described modifications of the embodiment in which more than three ejection-opening set rows are provided. FIG. 8A shows a basic row that is identical with the single ejection-opening set row 109 in the above-described embodiment. In the below-described modifications, each of the ejection-opening set rows may be interpreted as a modification of the basic row in which arrangement of the ejection-opening sets is changed regularly. It is noted that, in FIGS. 8A-8D, "A" represents the ejection opening set 108A, "B" represents the ejection opening set 108B, and each circled numeral represents a numeral of the ejection opening set as counted from an end of the ejection-opening set row. It is further noted that, in FIGS. 8A-8D, a 21st ejection opening set and other ejection opening sets located on a right side of the 21st ejection opening set are not illustrated for simplification.

In a modification, as shown in FIG. 8B by way of example, the ejection opening sets are arranged in an even number (e.g., six) of rows. In this modification, a first row is formed by cooperation of the ejection-opening set 108A that is located in the end of the basic row shown in FIG. 8A and every sixth ejection-opening set as counted from this ejection-opening set 108A in the basic row. That is, the first row is formed by cooperation of the ejection-opening sets 108A including the first, seventh, thirteenth and nineteenth ejection-opening sets as counted from the end of the basic row. A second row is formed by cooperation of the ejection-opening set 108B that is the second ejection-opening set as counted from the end of the basic row and every sixth ejection-opening set as counted from the second ejection-opening set. The other rows, i.e., the third through sixth rows, are formed in the same manner. In each of the first through sixth rows, positions of the respective ejection-opening sets are the same as positions of these ejection-opening sets in the basic row in the main scanning direction.

In this modification as shown in FIG. 8B by way of example, where the ejection opening set 108A is located in the end of the basic row, each of the first, third and fifth rows is constituted by only the ejection opening sets 108A, while each of the second, fourth and sixth rows is constituted by only the ejection opening sets 108B. It is noted that the first through sixth rows do not have to be necessarily arranged in order of numeral of the row, and the order of arrangement in the sub-scanning direction may be changed as needed. For example, each two ejection-opening set rows, which are assigned to form pixels that are adjacent to each other in the main scanning direction, may be located on respective opposite sides of at least one another ejection-opening set row in the sub-scanning direction, so that each pixel can be formed in a dried area of the sheet P, in other word, so that it is possible to avoid a pixel from being formed in an area of the sheet P which is not yet dried due to another pixel that is formed in an adjacent area immediately before the formation of the pixel in question. In this arrangement, the number of the above-described at least one another ejection-opening set row interposed between the above-described each two ejection-opening set rows is set to a number which does not cause the image quality to be reduced due to a displacement of the above-described another pixel (that is formed in the adjacent area before the formation of the pixel in question) in the main scanning direction by the conveyance of the sheet in a period of time from the formation of the above-described another pixel until the formation of the pixel in question.

In a modification as shown in FIG. 8C by way of example, the ejection opening set are arranged in an odd number (e.g., five) of rows. In this modification, a first row is formed by cooperation of the ejection-opening set 108A that is located in the end of the basic row shown in FIG. 8A and every fifth ejection-opening set as counted from this ejection-opening set 108A in the basic row. In this modification, each of the ejection opening set rows is constituted by the ejection opening sets 108A and the ejection opening sets 108B which are alternately arranged in the main scanning direction. In each of the first through fifth rows, positions of the respective ejection-opening sets are the same as positions of these ejection-opening sets in the basic row in the main scanning direction.

In a modification as shown in FIG. 8D by way of example, pairs of the ejection opening sets 108A, 108B are arranged such that each of the pairs of ejection opening sets 108A, 108B, which consists of two ejection opening sets 108A, 108B that are adjacent to each other in the main scanning direction, belong to a corresponding one of the ejection-opening set rows. In each of the ejection-opening set rows, positions of the respective ejection-opening sets are the same as positions of these ejection-opening sets in the basic row in the main scanning direction. In this modification, too, it is possible to reduce a number of the ejection openings 108 per an unit area of the nozzle plate 130, and accordingly to restrain a reduction in a strength of local portions of the nozzle plate 130.

While the presently preferred embodiment of the present invention and the modifications have been described above in detail, it is to be understood that the invention is not limited to the details of the illustrated embodiment and modifications, but may be otherwise embodied. For example, the above-described imaginary straight line LA, which is defined to connect between centers of the respective ejection openings 108 of the ejection opening set 108A, may be inclined with respect to the above-described imaginary straight line LC, by a degree that is larger than 0° and smaller than 45° or a degree that is larger than 45° and smaller than 90°. In this modification, too, when two straight lines orthogonal to each other are drawn, it is possible to restrain variation between the drawn straight lines with respect to the thickness or width of the line, and accordingly to restrain a reduction in image quality.

Further, each of the ejection opening sets 108A, 108B may be constituted by three or more ejection openings 108, as long as centers of the respective the three or more ejection openings 108 of each of the ejection opening sets 108A, 108B lies on a straight line. A dot DA, which is to be formed by each ejection opening set 108A, is constituted by cooperation of two ink droplets DA1 ejected through respective two ejection openings 108 located in respective opposite ends of this ejection opening set and at least one ink droplet DA1 ejected through at least one ejection opening 108 located between the two ejection openings 108, wherein the two ink droplets DA1 and the at least one ink droplet DA1 lie on a straight line. A dot DB, which is to be formed by each ejection opening set 108B, is constituted like the dot DA. Also in this modification in which each ejection opening set is constituted by three or more ejection openings 108, it is possible to obtain the same technical effect as in the above-described embodiment and modifications.

Further, the number and positions of the ejection openings 108 constituting each ejection opening set are not particularly limited to the details of the above-described embodiment and modifications. The size and shape of the pixel formed on the sheet P are dependent on an arrangement of the ejection openings 108, i.e., the number and positions of the ejection openings 108. The pixel formed by the ink droplets ejected through the plurality of ejection holes 108 is likely to have a non-perfect circular shape, i.e., a shape deviated from a perfect circular shape. The pixel has a center or a center of gravity as seen in a plan view, and a long axis and a short axis passing through the center or center of gravity can be imaginarily defined. In the arrangement of the ejection openings 108, it is possible to define a center (or center of gravity) corresponding to the center (or center of gravity) of the pixel and a straight line L' corresponding to the long axis of the pixel. Therefore, the arrangement of the ejection openings 108 can correspond to either the above-described ejection opening set 108A or ejection opening set 108B.

The liquid ejection head according to the invention may be constructed to include: (a) an ejection surface 1*a* having a plurality of ejection opening sets that are equally spaced apart from each other in a main scanning direction, each of the ejection opening sets consisting of at least two ejection openings 108 that are adjacent to each other in the main scanning direction; (b) a plurality of pressure chambers 110; (c) a plurality of individual liquid channels connecting each of the pressure chambers 110 to a corresponding one of the ejection opening sets; and (d) an actuator unit as an ejection energy applier configured to apply an ejection energy to a liquid stored in selected at least one of the pressure chambers 110 so as to cause liquid droplets to be ejected through at least one of the ejection opening sets that are connected to the selected at least one of the pressure chambers 110, such that the liquid droplets ejected through the at least two ejection openings 108 constituting each of the at least one of the ejection opening sets cooperate with each other to form a single pixel. The at least two ejection openings 108 of each of the ejection opening sets are positioned relative to each other, such that a straight line that is defined in an arrangement of the at least two ejection openings 108 is parallel with the ejection surface 1*a* and an intersecting direction that intersects with the main scanning direction and a sub-scanning direction. The straight line passes through a center of gravity of the arrangement of the at least two ejection openings 108 which corresponds to a center of gravity of the single pixel, and corresponds to a long axis of the single pixel passing through the center of gravity of the single pixel. The straight line defined in one of each adjacent two of the ejection opening sets, which are adjacent to each other in the main scanning direction, and the straight line defined in another of the each adjacent two of the ejection opening sets, are inclined with respect to the sub-scanning direction, in respective directions opposite to each other. In this construction, too, it is possible to obtain the same technical effect as in the above-described embodiment and modifications.

The present invention is applicable also to a liquid ejection head that is configured to eject a liquid other than the ink. Further, the present invention is applicable to any liquid ejection head, irrespective of kind of a system for ejecting a liquid. For example, in the above-described embodiment and modifications, piezoelectric elements are used for ejecting the liquid. However, an electric resistance heating system or a capacitance system may be used.

What is claimed is:

1. A liquid ejection head comprising:

an ejection surface having a plurality of ejection opening sets that are equally spaced apart from each other in a given direction, each of said ejection opening sets consisting of at least two ejection openings that are adjacent to each other in said given direction;

a plurality of pressure chambers;

a plurality of individual liquid channels connecting each of said pressure chambers to a corresponding one of said ejection opening sets; and an ejection energy applier configured to apply an ejection energy to a liquid stored in selected at least one of said pressure chambers so as to cause liquid droplets to be ejected through at least one of said ejection opening sets that are connected to said selected at least one of said pressure chambers, such that the liquid droplets ejected through said at least two ejection openings constituting each of said at least one of said ejection opening sets cooperate with each other to form a single pixel, wherein said at least two ejection openings of each of said ejection opening sets are positioned relative to each other, such that a straight line that is defined to connect between centers of said respective at least two ejection openings is parallel with said ejection surface and is inclined with respect to said given direction and a perpendicular direction that is perpendicular to said given direction, and such that said straight line defined in one of each adjacent two of said ejection opening sets, which are adjacent to each other in said given direction, and said straight line defined in another of said each adjacent two of said ejection opening sets, are inclined with respect to said perpendicular direction, in respective directions opposite to each other;

wherein said plurality of pressure chambers are configured to store the liquid of a single color so that the liquid droplets of the single color are ejectable through said ejection opening sets that are connected to said pressure chambers; and wherein said liquid ejection head is configured to perform an image recording, by ejecting the liquid droplets of the single color through said at least one of said ejection opening sets, onto a recording medium during conveyance of the recording medium relative to said liquid ejection head in said perpendicular direction, without movement of the recording medium relative to said liquid ejection head in said given direction.

2. The liquid ejection head according to claim 1, comprising a plate having: a surface that serves as said ejection surface; and a plurality of through-holes which are formed through said plate and which have respective openings that serve said respective ejection openings.

3. The liquid ejection head according to claim 2, wherein said plurality of ejection opening sets of said ejection surface are arranged to form a plurality of ejection-opening set rows which extend in said given direction and which are arranged in said perpendicular direction.

4. The liquid ejection head according to claim 3, wherein said at least two ejection openings of each of said ejection opening sets are positioned relative to each other, such that said straight line defined in each of said ejection opening sets that form one of each adjacent two of said ejection-opening set rows, which are adjacent to each other in said perpendicular direction, and said straight line defined in each of said ejection opening sets that form another of said each adjacent two of said ejection-opening set rows, are inclined with respect to said perpendicular direction, in respective directions opposite to each other.

5. The liquid ejection head according to claim 2, wherein said plurality of ejection opening sets of said ejection surface are arranged to form a single ejection-opening set row that extends in said given direction.

6. The liquid ejection head according to claim 2, wherein said plurality of through-holes have respective openings opening in another surface of said plate which is opposite to said ejection surface, and wherein said another surface includes a flat surface area that is located between each set of said openings which open in said another surface and which correspond to a corresponding one of said ejection opening sets, said flat surface area being parallel with said ejection surface and perpendicular to a liquid flow direction in which the liquid is to flow through said through-holes.

7. The liquid ejection head according to claim 1, wherein said at least two ejection openings of each of said ejection opening sets are positioned relative to each other, such that said straight line defined in one of each adjacent two of said ejection opening sets, which are adjacent to each other in said given direction, is inclined by 45.degree. with respect to an imaginary straight line parallel with said given direction, and such that said straight line defined in another of said each adjacent two of said ejection opening sets is inclined by 135.degree. with respect to said imaginary straight line parallel with said given direction.

8. A liquid ejection recording device comprising:

the liquid ejection head recited in claim 1; and a sheet conveyor configured to convey a recording medium that is to be subjected to an image recording performed by said liquid ejection recording device, wherein the image recording is performed by ejection of the liquid droplets from said liquid ejection head, during conveyance of the recording medium relative to said liquid ejection head in said perpendicular direction, without movement of the recording medium relative to said liquid ejection head in said given direction.

* * * * *